US006616381B2

(12) United States Patent
Larsen, Jr.

(10) Patent No.: US 6,616,381 B2
(45) Date of Patent: Sep. 9, 2003

(54) PILING SOLUTION

(76) Inventor: John E. Larsen, Jr., 11557 Discovery Ht. Cir., Anchorage, AK (US) 99515

( * ) Notice: Subject to any disclaimer, the term of this patent is extended or adjusted under 35 U.S.C. 154(b) by 0 days.

(21) Appl. No.: 10/054,848

(22) Filed: Jan. 25, 2002

(65) Prior Publication Data

US 2003/0143036 A1 Jul. 31, 2003

(51) Int. Cl.[7] ..... E02D 7/02
(52) U.S. Cl. ..... 405/232; 405/229; 405/284
(58) Field of Search ..... 405/232, 229, 405/284

(56) References Cited

U.S. PATENT DOCUMENTS

| | | | | | |
|---|---|---|---|---|---|
| 3,180,099 | A | * | 4/1965 | Mikolajczyk et al. | 405/216 |
| 3,370,432 | A | * | 2/1968 | Butler et al. | 405/216 |
| 3,630,037 | A | * | 12/1971 | Howard | 405/232 |
| 4,464,083 | A | * | 8/1984 | Wathey | 405/216 |
| 4,585,681 | A | * | 4/1986 | Kidera et al. | 405/231 |
| 4,721,418 | A | | 1/1988 | Queen | |
| 4,818,148 | A | * | 4/1989 | Takeda et al. | 405/234 |
| 5,177,919 | A | * | 1/1993 | Dykmans | 52/298 |
| 6,179,526 | B1 | * | 1/2001 | Knight et al. | 405/232 |

OTHER PUBLICATIONS

Design Standards for Government Facilities, Government of Yukon, Feb. 9, 1999, section S Structural Design Standards, pp. 1–5 of 7.*

Stark et al., Expedient MESL Construction in COld Weather, Technical report ERDC/CRREL TR–00–9, US Army Corps of Engineers, Jul. 2000; 21 pages and appendix A.* www.reefindustries.com/permalon.html. Description of Permalon™, 1 page.*

Foundations and stands, triple stage cribbing stand'from www.perfectaline.com/crawlspacesetting.com, 5 pages, date being verified as prior to Jan. 25, 2001.*

Pub. No. US2002/0001506A1: Pub. Date: Jan. 3, 2002.

* cited by examiner

*Primary Examiner*—J. J. Swann
*Assistant Examiner*—Katherine Mitchell
(74) *Attorney, Agent, or Firm*—Merek, Blackmon & Voorhees, LLC

(57) ABSTRACT

An anti-jacking pile solution particularly suited for use in permafrost or cold regions. The pile includes bond breaking material for preventing frozen soil from directly gripping a pile near the surface of the soil and pulling the pile upward. A collar is attached to the pile to prevent damage and/or displacement of the bond breaking material during driving of the pile. The pile may be attached to a building by way of an adjustable connection system allowing for future adjustments in the event of vertical movement.

8 Claims, 3 Drawing Sheets

PILING SOLUTION

FIELD OF THE INVENTION

The present invention relates to building foundations and in, particular pile foundations.

BACKGROUND OF THE INVENTION

Alaska and the Northern Regions are besieged by permafrost and ice rich soils conditions that make the construction of effective and economical foundation systems very difficult and costly. Foundations constantly fail and cause extensive damage to housing and other structures. Although foundation systems have been designed to solve these problems, they are generally not economically feasible for homes, in particular, as well as many other buildings. The budgets available for the construction of housing is not adequate for the installation of elaborate piling or refrigerated systems used for large commercial structures. In fact, the majority of homeowners living in the permafrost regions of Alaska simply acquiesce to high maintenance and repair costs of their homes caused by foundation movement.

Two types of foundations are typically used for housing and light buildings constructed in areas having permafrost conditions. One is "post and pad" and the other is piling. Although the post and pad system may have many variations, it commonly consists of wood or steel posts designed and supported on treated timber footings. The houses using this system are subject to high vertical and differential movement. The annual freeze-thaw cycles and frost heaves under the pads cause movement resulting in structural stresses to the houses resulting in cracking wallboard, plumbing breaks, broken window seals and doors jamming and in some severe cases, almost total failure of the houses. Most post and pad systems are difficult to adjust once they have moved and trying to re-level the houses has been a major challenge.

Prior piling systems include wood piles, steel piles, round and H driven piles and thermopiles. Generally, these piling systems are far to expensive for housing and small projects because of high materials costs and the cost of heavy equipment such as augers and cranes to install piles at remote locations. Driven steel piles are generally the most economical of the pile systems but it has been costly to install reliable bond breakers on driven piles to prevent jacking. Jacking is characterized as a gradual uplift of the pile due to the freeze thaw action of the surrounding soil. The freeze thaw action causes the surrounding soil to grip the upper part of the pile and lifts it upward. The reason for this is that the soil near the surface has a much stronger adfreeze bond or grip on the pile than does the warmer soil at depth. Therefore, without bond breakers, steel piles can be problematic for use in foundations in permafrost regions. In these prior piling systems, when bond breakers are used, the top five to seven feet of soil around the pile has to be dug out or a large diameter hole is predrilled so the bond breaker can be attached after insertion of the pile into the soil, resulting in wasted time and expense.

In view of the foregoing it can be seen that there is a need for an effective and economical foundation system for housing and other buildings in permafrost regions.

OBJECTS AND SUMMARY OF THE INVENTION

Therefore, it is an object of the invention to provide an anti-jacking pile for use in foundation systems.

Another object of the invention is to provide a pile having an anti-jacking covering thereon to resist the effects of freeze-thaw cycles in permafrost regions.

Still another object of the invention is to provide a collar for facilitating driving of a pile into soil.

Yet another object of the invention is to provide a collar attached to a pile for preventing damage to an anti-jacking covering on the pile.

Still another object of the invention is to provide a method of installing a pile having an anti-jacking covering thereon.

Yet another object of the invention is to provide an adjustable leveling system as a long-term contingency so that the house can be re-leveled in the event of vertical movement.

These and other objects, uses and advantages will be apparent from a reading of the description which follows with reference to the accompanying drawings forming a part thereof.

In summary, the invention is directed to an anti-jacking pile solution particularly suited for use in permafrost and cold regions. The pile includes bond breaking material for preventing frozen soil from directly gripping a pile near the surface of the soil and pulling the pile upward. A collar is attached to the pile to prevent damage and/or displacement of the bond breaking material during driving of the pile. The pile may be attached to a structure by way of an adjustable connection system.

DETAILED DESCRIPTION OF THE INVENTION

Figure 1:
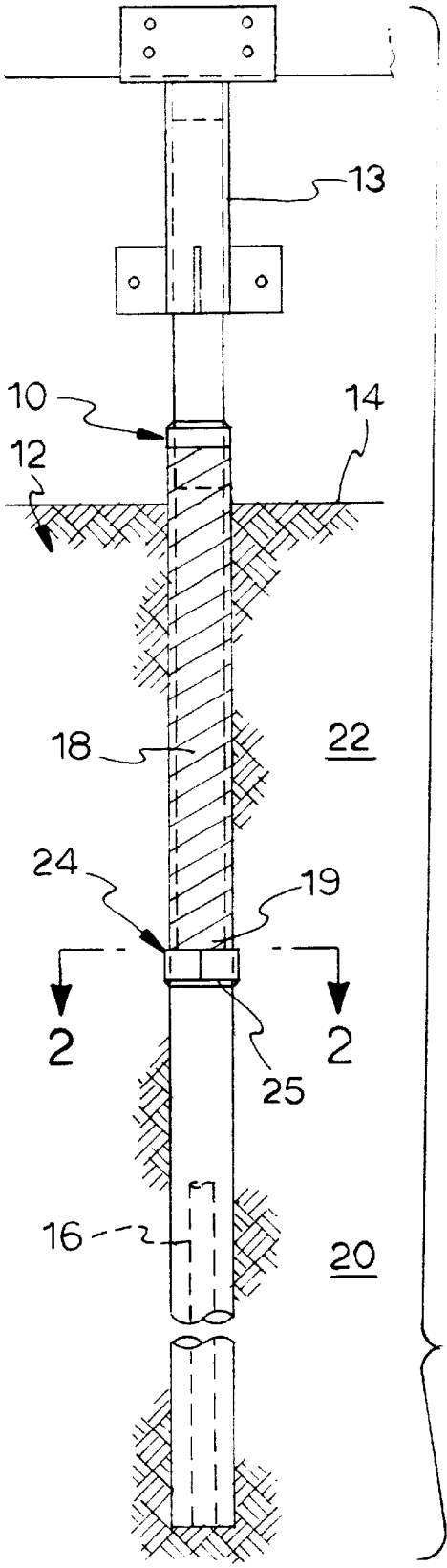
FIG. 1 is an elevation view of the method of the anti-jacking pile installed in the ground.

FIG. 1 shows a pile 10 after it has been driven into place into the soil 12. A connection portion 13 of the pile 10 extends above the surface 14 of the soil 12. The diameter and thickness of a steel pile will vary according to the particular building or structure design.

A pilot hole 16 may be drilled into the soil 12 to facilitate driving of the pile 10. A bond breaker material 18, is applied to the pile 10 prior to driving of the pile into the soil 12. The bond breaker material 18, is preferably a plastic material such that marketed under the names PERMALON® or CANVEX CB12WB, both of which have good elastic qualities under subfreezing conditions. Preferably, the bond breaker material 18 comes in six and eight foot wide rolls having ten to twelve mil thickness and is fastened to pile 10 with an approximately two-inch wide tape. The bond breaker material 18 is wrapped around the pile 10 in two layers and the first layer has a ½ pipe circumference overlap. It should be understood that the width of the bond breaker material 18 could vary and other products having similar good elastic qualities under subfreezing conditions could be substituted. Seams between adjacent wraps are preferably taped full length of the wrap and the lower end 19 of the bond breaker material 18 should also be taped in a thickness necessary to provide a sufficient clamping surface. Alternatively, a layer of grease may be applied to the pile 10 prior to application of the bond breaker material to further facilitate movement of the bond breaker material 18 relative to the pile 10 during soil movement.

In regions of Alaska, the continuous permafrost 20 may extend 1800 feet below the surface 14 of the soil 12. At the surface 14, the soil 12 may unthaw and refreeze to a much colder temperature than the permafrost 20. This area of the soil 12 between the surface 14 and the continuous permafrost 20 is known as the active layer 22. This active layer 22 is the part of the soil 12 that acts to pull the pile 10 upwardly as the soil 12 expands during frost heaves. Therefore, it is the portion of the pile 10 that is to be permanently located the active layer 22 that needs to be covered by the bond breaker material 18. The active layer 22 is generally less than five feet in depth and therefore it is preferred that the bond breaker material 18 be applied to that portion of the pile 10 and preferably extending a few inches above the surface 14 of the soil 12 to compensate for uplift of the soil during frost heaves. It should be understood by one skilled in the art that the depth of the pile 10 into the soil 12 will vary according to construction requirements, and it should be understood that the pile 10 will generally extend fifteen to twenty-five feet farther into the continuous permafrost 20 for conventional housing construction.

Figure 2:
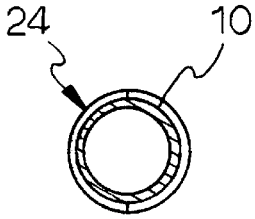
FIG. 2 is a top section view of the collar of the anti-jacking pile.

A collar 24 is attached to the pile 10 adjacent the lower end 19 of the bond breaker material 18. The collar 24 is preferably constructed of steel. As shown looking at both FIGS. 1 and 2, the collar 24 extends circumferentially around the pile 10 preferably overlapping the bond breaker material 18 and tightly engaged thereto to hold the bond breaker material 18 in place during welding of the collar to the pile 10. Prior to driving the pile 10, the collar 24 is preferably fillet welded in place along its lower edge 25. The collar 24 is generally constructed of ¼ inch in thickness and approximately four inches in height. Although these dimensions are preferred, they may be varied as long as the function of the collar 24 of protecting the bond breaker material 18 during driving of the pile 10 is performed. The diameter of the collar 24 will vary in accordance with the diameter of the pile 10 being driven. Piles 10 for typical housing construction are six inches to ten inches in diameter.

Now looking to FIGS. 3, 4, 5 and 6, the supporting beams 30 of a building (not shown) are connected to the pile 10 by an adjustable connection system 32. The system uses a two-part telescoping sleeve 34 and post 36 which slides into pile 10 and is welded thereto. The sleeve 34 includes four plates 38, 40, 42 and 44 extending horizontally outwardly from the sleeve 34 to accept connection to support struts 46, 48, 50 and 52. The opposite ends of support struts 46, 48, 50 and 52 are connected to brackets 54, 56, 58 and 60 which are in turn connected to the support beams 30.

Figure 5:
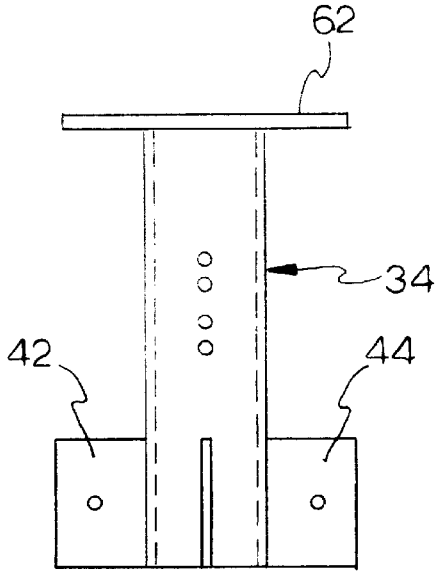
FIG. 5 is a side view of the connection plate for connecting the adjustable leveling system to the anti-jacking pile.
Figure 6:
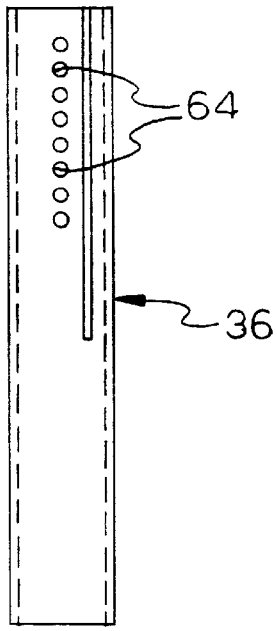
FIG. 6 is a side view of the adjustment post.
Figure 3:
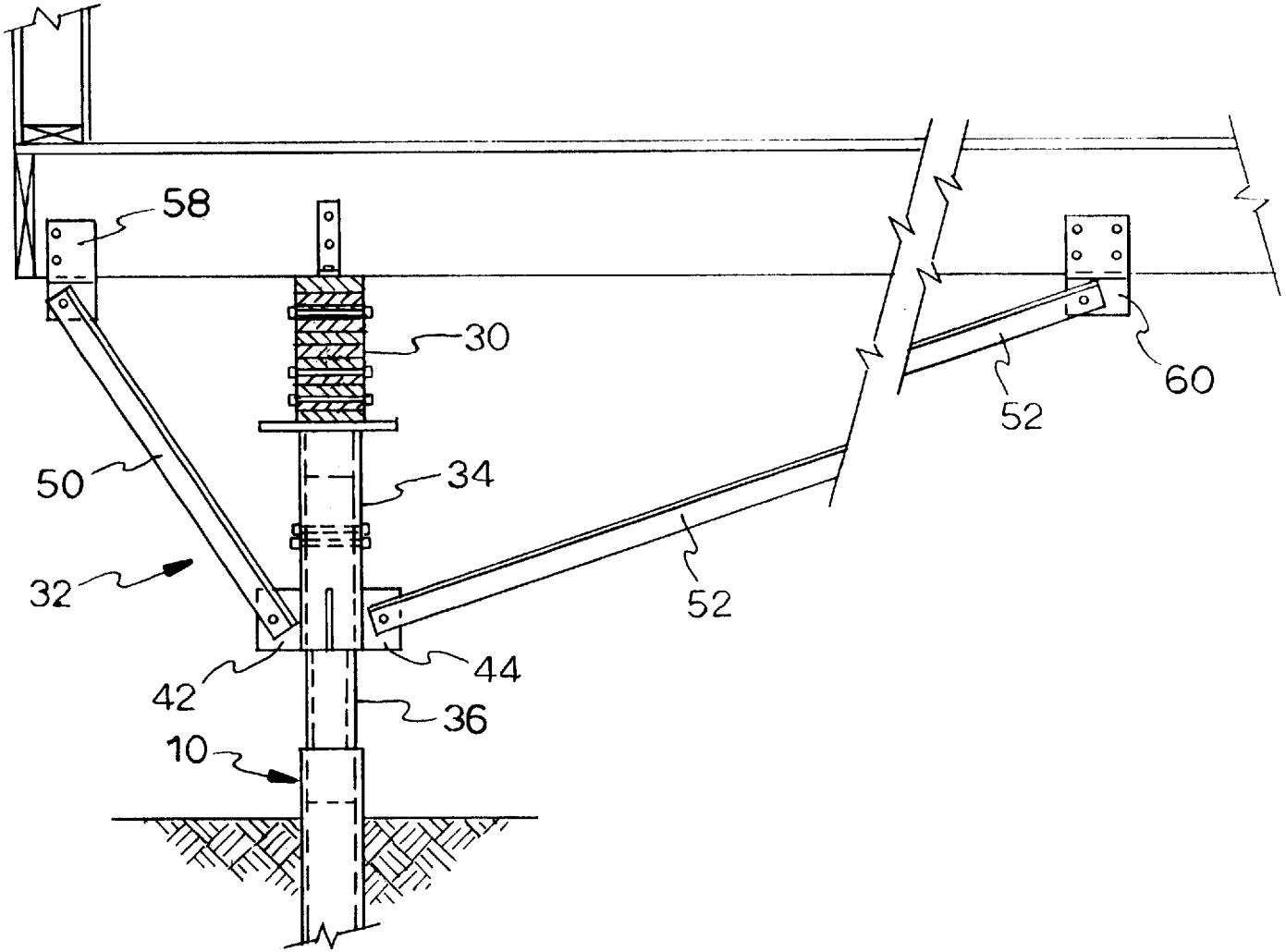
FIGS. 3 and 4 are fragmentary elevation section views of the connection of the adjustable leveling system and the upper portion of the anti-jacking pile.
Figure 4:
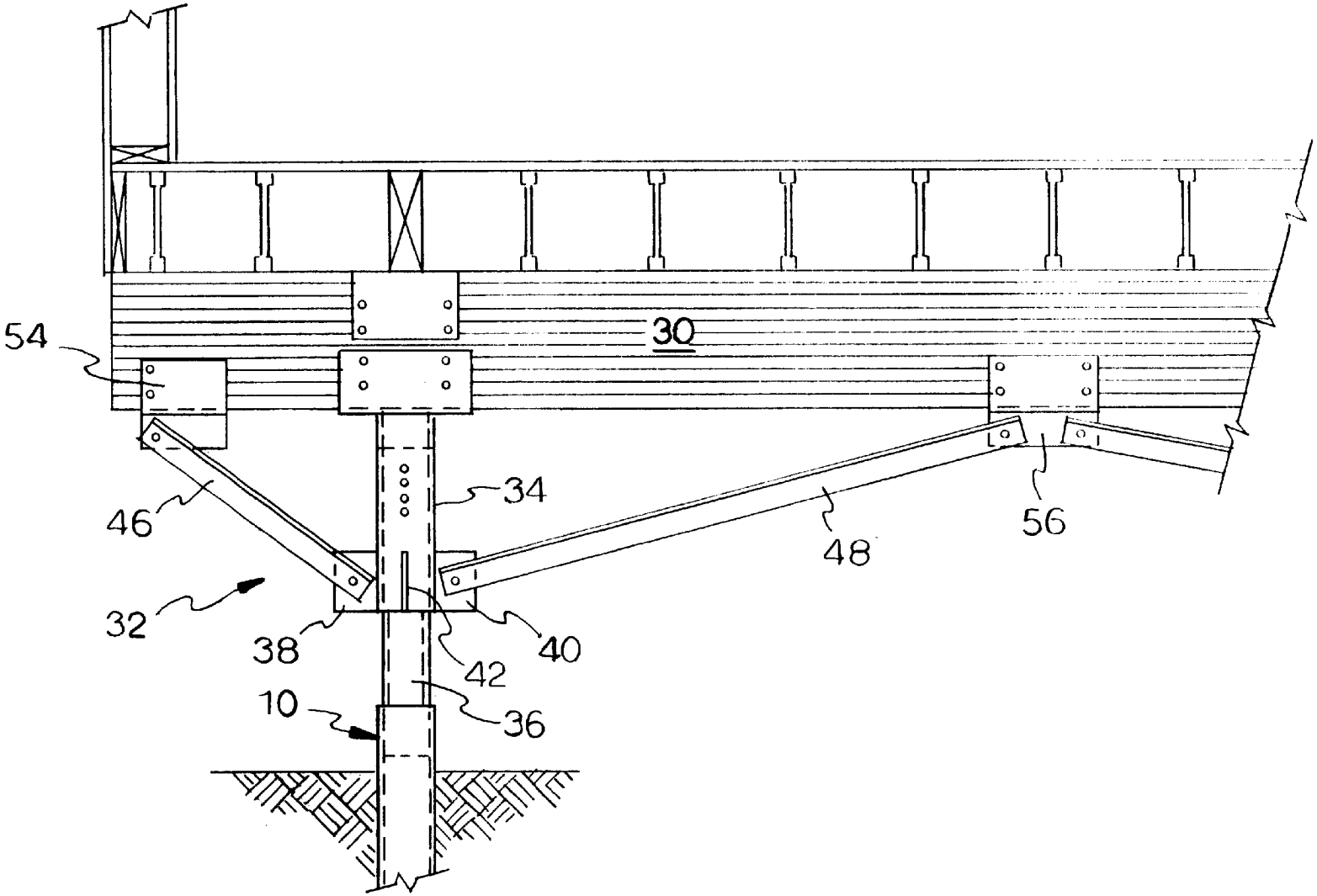

As shown in FIG. 5, a plate 62 is used to join sleeve 34 directly to support beam 30. Plate 62 provides a larger surface to engage support beam 30 to allow for slight variations in alignment. Sleeve 34 slidably engages post 36 which slides into pile 10 and is welded thereto. The telescoping sleeve 34 and post 36 are adjustably connected by bolts. Post 36 includes a plurality of holes 64 to facilitate vertical adjustment of the telescoping sleeve 34.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

I claim:

1. A method of installing an anti-jacking pile system, comprising the steps of;

a) wrapping a section of outer surface of a pile with a bond breaking material, said section having an upper end and a lower end;

b) attaching a collar at a location adjacent said bond breaking material at said lower end of said section and further attaching said collar directly to said outer surface of a pile for protecting said bond breaking material from being damaged by the surrounding soil during driving of said pile;

c) driving said pile into soil a sufficient depth to act as a support for a building.

2. The method as set forth in claim 1, further including the step of;

a) applying a coating of lubricant to said pile prior to wrapping said section with said bond breaking material.

3. The method as set forth in claim 1, wherein the step of attaching a collar further includes;

a) welding a lower portion of said collar to said outer surface of said pile to prevent said collar from moving upward as said pile is driven.

4. The method as set forth in claim 1, wherein the step of attaching a collar further includes;

a) placing said collar around a portion of the lower end of said bond breaking material to hold said bond breaking material in place during driving of said pile.

5. The method as set forth in claim 1, wherein;

a) said bond breaking material is plastic.

6. The method as set forth in claim 1, wherein the step of attaching a collar further includes;

a) clamping said collar onto said bond breaking material.

7. The method as set forth in claim 1, further comprising the step of;

a) joining said pile to a building using adjustable leveling system.

8. The method as set forth in claim 7, wherein;

a) said adjustable leveling system includes a steel plate joined to said pile for providing an adjustable base for connecting said pile system to said adjustable leveling system;

b) said steel plate is joined to a sleeve which is telescopingly connected to a post extending from said pile for facilitating vertical adjustment.

* * * * *